US007849540B2

(12) United States Patent
Hill

(10) Patent No.: US 7,849,540 B2
(45) Date of Patent: Dec. 14, 2010

(54) REUSABLE SURGICAL PERIOPERATIVE POSITIONING SYSTEM

(75) Inventor: Darrell G. Hill, Palm Desert, CA (US)

(73) Assignee: Health Care Positioners, Inc., Palm Desert, CA (US)

( * ) Notice: Subject to any disclaimer, the term of this patent is extended or adjusted under 35 U.S.C. 154(b) by 637 days.

(21) Appl. No.: 11/897,522

(22) Filed: Aug. 30, 2007

(65) Prior Publication Data

US 2008/0052834 A1 Mar. 6, 2008

Related U.S. Application Data

(60) Provisional application No. 60/841,034, filed on Aug. 30, 2006.

(51) Int. Cl.
*A47C 16/00* (2006.01)

(52) U.S. Cl. ..... 5/632; 5/621; 5/624; 5/640

(58) Field of Classification Search ..... 5/621–624, 5/632, 655.3, 640, 648
See application file for complete search history.

(56) References Cited

U.S. PATENT DOCUMENTS

| | | | | |
|---|---|---|---|---|
| 2,085,296 | A | 6/1937 | Carey | |
| 2,822,554 | A * | 2/1958 | Wenzelberger | 5/644 |
| 2,933,738 | A | 4/1960 | Whelan | |
| 3,158,878 | A | 12/1964 | Pernell | |
| 3,846,857 | A * | 11/1974 | Weinstock | 5/727 |
| 3,939,829 | A | 2/1976 | Spann | |
| 3,970,079 | A | 7/1976 | Gaylord, Jr. | |
| 4,108,170 | A | 8/1978 | Spann | |
| 4,236,265 | A | 12/1980 | Carradine | |
| 4,302,272 | A | 11/1981 | Phillips et al. | |
| 4,396,013 | A | 8/1983 | Hasslinger | |
| 4,628,557 | A * | 12/1986 | Murphy | 5/723 |
| 4,662,517 | A | 5/1987 | Wirth | |
| 4,899,763 | A | 2/1990 | Sebastian et al. | |
| 5,400,449 | A * | 3/1995 | Satto | 5/631 |
| 5,492,133 | A | 2/1996 | McVicker | |
| 5,664,581 | A | 9/1997 | Ashley | |
| 6,053,169 | A | 4/2000 | Hunt | |

OTHER PUBLICATIONS

HealthStream®; Positioning A Patient Safety Initiative; Study Guide For Nurses; CONMED® Corporation; © 2003; 66 pages.
Pfiedler Enterprises; CONMED® Corporation; Positioning A Patient Safety Initiative; Study Guide For Nurses; © 2006; 45 pages.
AirSoft™; CONMED® Patient Care; Reusable Positioning Systems; Promoting Safety For All Perioperative Areas and Surgical Patients; © 2003; 12 pages.
In-Touch®; Information on Flexible Polyurethane Foam; vol. 3, No. 1, Mar. 1993; 4 pages.

* cited by examiner

*Primary Examiner*—Fredrick Conley
(74) *Attorney, Agent, or Firm*—Patterson Thuente Christensen Pedersen, PA

(57) ABSTRACT

A support system including a cushion or pad having a foam core and cover is disclosed. The support system is capable of taking a variety of different shapes and can be adjusted for firmness. The support system may be used during and after surgery and more generally, any time when it is desirable to utilize a sterilizable, adjustable cushion. Additionally, multiple cushions may be used in a variety of combinations at any one time.

18 Claims, 10 Drawing Sheets

REUSABLE SURGICAL PERIOPERATIVE POSITIONING SYSTEM

RELATED APPLICATION

The present application claims the benefit of U.S. Provisional Application No. 60/841,034 filed Aug. 30, 2006, entitled "Positioning System for Use in a Perioperative Environment" which is incorporated herein in its entirety by reference.

FIELD OF THE INVENTION

The present invention relates generally to the field of medical positioning systems including pads and cushions that are used in a perioperative environment.

BACKGROUND OF THE INVENTION

The perioperative environment includes surgical operating rooms and related areas of hospitals and surgical centers. The perioperative environment includes but is not limited to: the operating room, one day surgery areas, trauma units, critical care areas, plastic surgery, neonatal intensive care, patient transportation, obstetrics, the post anesthesia care unit, radiology, X-ray, the electrophysiology lab, nursing services and the neonatal care unit.

During surgery, a patient may spend a great deal of time lying on a 20 inch wide surgical bed table where the patient is positioned by various devices, pads and cushions. Generally, hospitals provide fairly crude positioning devices for this positioning process. For example, patients may be propped into a selected operative position by rolled-up sections of bath blankets, disposable foam and surgical towels. However, these fairly crude positioning devices do not provide an acceptable degree of stability and do not facilitate appropriate safety as noted by the Association of Operating Room Nurses (A.O.R.N.).

Furthermore, for example, a rolled bath blanket used for a chest roll in the prone position can create peak pressure points that may cause capillary occlusion. A restriction of blood flow or capillary occlusion can cause post-operative decubitus ulcers and hence can require a long term costly physical therapy regimen. In addition, high interface pressure can lead to localized nerve damage, tissue damage or damage to muscles and bones.

The most common post-operative injuries are decubitus ulcers, also known as bed sores or pressure sores. Decubitus ulcers are wounds that form due to prolonged pressure on a particular point on the body, which constricts blood flow. Such pressure sores may result from a positioning device that creates high pressure (over 32 mmHg) against the skin. Once formed, pressure sores can take months to heal and can actually become life-threatening. The average cost to treat one Stage II decubitus wound is $40,000 to $50,000, according to the National Wound Care Association.

It is estimated that 23-25% of post-operative decubitus ulcers arise from damage that initially occurs due to high interface pressure on a specific area on the skin that occurs during surgery. The risk of decubitus ulcer development increases in patients that are prone to reduced circulation such as diabetics and the elderly. Decubitus ulcers lead to increased costs for medical care as well as increased cost that arises from potential medical malpractice claims; estimates of cost for this type of post-operative injury totals $2-$10 billion dollars per year.

Pressure ulcers may be a complication of immobility. The major cause of pressure ulcers is generally accepted to be an external pressure that occludes blood vessels (capillary occlusion).

Two distinct mechanical forces that contribute to pressure ulcers are a direct downward pressure and shear pressure.

Tissue Interface Pressure (TIP) is a direct downward vertical pressure, can occlude blood capillaries and cause ischemia to the area supplied by the affected vessels. Prolonged ischemia leads to cell and tissue death.

Shear Pressure is a horizontal force that occurs when the skin and underlying subcutaneous tissues are pulled taut and over-stretched, causing tissue deformity, obstructing blood flow and tissue necrosis.

Pressure and Shear will be higher in areas where soft tissue lies over bony surfaces. Forces over bony prominences should be reduced whenever possible.

Surgical procedures of greater than two hours and procedures that involve the cardiovascular system may cause an otherwise low risk patient to be at risk for harm. Patient positioning in surgery in general needs to be assessed carefully and surfaces used in positioning should meet recommended A.O.R.N. standards for positioning.

Positioning products commonly used by hospitals today include:

1. Reusable surgical towels.
2. Reusable bath blankets.
3. Disposable foam pads.
4. 2" stitched surgical table pad.
5. Stitched, dipped and sprayed foam products.
6. Sheets, pillow cases and stitched pillows.
7. Various gel pads.
8. Rolled towels, sheets or bath blankets, often held with tape.

None of the presently used positioning products has been recommended as clinically sound for the positioning the patient by the U.S. A.O.R.N. (Association of Operating Room Nurses). In 2002, the A.O.R.N. declared positioning as a major safety concern in the perioperative environment.

Consequently, various cushioning devices or pillows have been developed for use in the medical field to alleviate dangers caused by rolled bath blankets, for example. Typical pillows or cushions are designed to provide support for a particular body part and have most often been produced for the following specific body parts: neck, head, foot and heels, sacral, trochanter, brachial plexus, and major surgical positions (supine, prone, lateral, Fowler and lithotomy). To provide such support, these cushions are sometimes constructed and designed to conform to the shape of the body part to be supported, too often with non-standard, inappropriate materials that are not tested for safe pressure outcomes, nor approved by the A.O.R.N for safe clinical practices.

Conventional stitched pillows are usually filled with a cushioning material of synthetic polyester, fiberfill or foam. Such pillows can be manipulated to conform to the shape of the body part to be supported. If the construction of the pillow is too firm, however, it becomes difficult to adjust the shape of the pillow to the body part. Conversely, if the pillow is too soft, depressions are easily formed, and the proper safe pressure of the body member is not achieved. Furthermore, the shaping capabilities of such conventional pillows are rather limited. Often, the filler simply packs into a dense mass and loses its resiliency. These positioners traditionally have stitched seams with rough edges that are exposed to the patient's skin, and thus also support the potential for cross-contamination after each use. Cross contamination can occur when pathogens such as bacteria or bodily fluids such as blood are trapped in the stitched seams or the thread itself. These products are cleaned and disinfected between surgical cases with low grade antimicrobials and are often used again for another procedure on another patient within fifteen minutes.

In response to the deficiencies of conventional filling material, inflatable cushions or pads have been developed. However, most of the prior inflatable pad cushions are very complicated structures that are costly to manufacture. Additionally, the prior inflatable cushions may be too firm, so pressure points and bed sores may still occur. Prior art inflatable cushions often also have stitched seams that may create pressure points and that may harbor pathogens.

Foam cushions may also create pressure points because the positioning cushions 'bottom out' due to inappropriate foam being used in combination with the correct foam thickness.

Accordingly, there exists a need in the art for improved positioning pads or cushions that are economical to use and that help reduce the potential for post-operative injury by providing safe interface pressures. Furthermore, there exists a need for such a pillow to be easily shaped or conformed to the desired configuration to provide support, while retaining sufficient resiliency to maintain the desired shape until it is intentionally changed by the user.

SUMMARY OF THE INVENTION

An improved support system and associated methods of preventing adverse health risks associated with surgery, such as pressure points and bed sores is described herein. The invention, in one embodiment, includes a 4" thick fluid-proof, conformable fabric cushion or surgical table pad having a foam core and conformable fabric cover. The cushions or pads optionally also includes a valve, which permits the passage of a fluid (i.e., air) into and/or out of the cushion. Because the amount of air in the cushion is adjustable, the present support system is easily shaped to the desired configuration to provide support for the patient, while retaining sufficient resiliency to maintain the desired shape until it is intentionally changed by the user. In one aspect, the present invention is adjustable to avoid high interface pressure points particularly during long term surgical procedures (over 2 hours). Pressure adjustment can be accomplished in a localized area, such as the patient's torso, to reduce the risk of pressure induced ischemia that may lead to decubitus ulcers, as well as post-operative nerve and muscle damage.

Generally, the present invention relates to the field of medical perioperative positioning and specifically to a standardized system of surgical table pads, stretcher pads, and related body positioning pads for protecting and stabilizing the patient in the perioperative environment by providing appropriate pads that conform to the bony prominences, while in doing so, providing reduced 'interface pressure' that helps protect the patient during the procedures while on the surgical table and reduce the post-operative trauma of skin, nerve and muscle damage.

The reusable surgical positioner system may be used to accommodate all perioperative surgical procedure positions—primarily the supine, prone, lateral, Fowler and lithotomy positions, and all modified positions related to these primary positions in surgery. For example, the invention may include a three piece surgical table pad, a stretcher pad and/or body positioning pads.

In one aspect, the reusable system of the invention has includes:

1. A conformable reusable outer fabric covering which is, fluid-proof and bacteria resistant. The fabric covering may exhibit Cytotoxicity and be tested for skin sensitization. The fabric is durable to allow for repeated usage and may be cleaned with normal hospital anti-microbial cleaning agents.
2. The fabric cover may be formed with Radio Frequency (RF) or similar welded seam on all pads and positioner products in the system that inhibit cross-contamination between procedures by eliminating stitched seams. Cross contamination is inhibited in part because the products in the system are fluid-proof and may be treated to be antibacterial.
3. Some embodiments include an air release valve for allowing air to be released during the procedure while the patient is on the pad/positioner. The valve allows air to be released, adjusting for the patient's weight while on the pad/positioner, thus providing a reduction of peak interface pressure on the primary bony prominences such as heel, trochanter, sacrum, ischium, brachial plexus, shoulder blade, elbow and head.

The table pad/positioner also facilitates stabilizing the patient on the surgical table during the procedure, thus providing and supporting a positive post-operative outcome by reducing the incidence of post-operative injury associated with inappropriate positioning devices presently commonly used in all United States health care hospitals.

The system of positioners is reusable and thus provides a strong economic benefit to the managers of the perioperative environment.

The reusable positioning system provides a comprehensive offering of positioning products with configured foam pads, covered with a conformable, fluid-proof, stretchable polyurethane fabric, RF welded that provides a system of products that can be reused by the surgical environment, and thus providing benefits in Major cost reduction to the health care facility, and Strong potential benefit of reduction of interface pressure which help reduce tissue, nerve and muscle damage The positioning system helps reduce pressure under the patient's positioned body area by releasing air from the RF welded pad through a valve which is electronically welded into the positioning device—such as a torso pad of a surgical table, a chest roll under a patient in a prone position, or a foot and heel pad under a patient's foot in a supine position on a surgical table. The positioner pads are all made of the same tested material thus creating a standard material application for each patient.

One aspect of the present invention includes a surgical table pad set adaptable for all tables in a variety of configurations, usually 3 to 5 pieces—head, torso, foot and 2 armboards.

An example surgical table pad includes:

1. A 4" height
2. A fluid-proof seam, RF welded or electronically or heat welded
3. A fluid-proof cover
4. A series of Velcro attachments to limit slippage on O.R. table. The attachments are located at the base of the pad—as needed
5. A conformable stretchable fabric
6. A foam inner core—having a variety of foam densities Regarding pressure reduction for a patient during surgery, one embodiment of the pad includes an air valve release that allows air to be released from the RF welded fabric envelop and thus reduces the interface pressure between the surface of the pad and the key pressure points of the patient thus more evenly distributing the weight of the patient over the surface of the pad. This allows the patient to better tolerate long and short surgical procedures. This helps to reduce the occurrence of post-operative injury, primarily tissue damage and nerve damage.

As the patient is positioned with a positioning pad within the system, the valve may or may not be opened based on the length of the procedure and other factors. If the procedure is short (less than 1 hour), the surgical staff may leave the valve closed, as the configuration of the pad (enclosed foam) and outer fluid-proof conformable cover will provide immediate pressure reduction in concert with the soft layers of foam. If the procedure is longer (over 2 hours) or if a patient is clinically compromised, the valve is rotated opening the airway to the inner core of the pad. As the air is released, the inner foam core adjusts to the weight of the patient, and reduces the pressure load on the most significant bony prominences, which helps distribute the total body weight so the surgical/perioperative patient can tolerate the procedures without serious concern for tissue or nerve damage. This is safety feature and benefit built into the positioner system that creates a new standard for safety in all surgical patient procedures in the United States versus the variety of textile and stitched products now commonly used in the perioperative environment.

DETAILED DESCRIPTION

Figure 1:
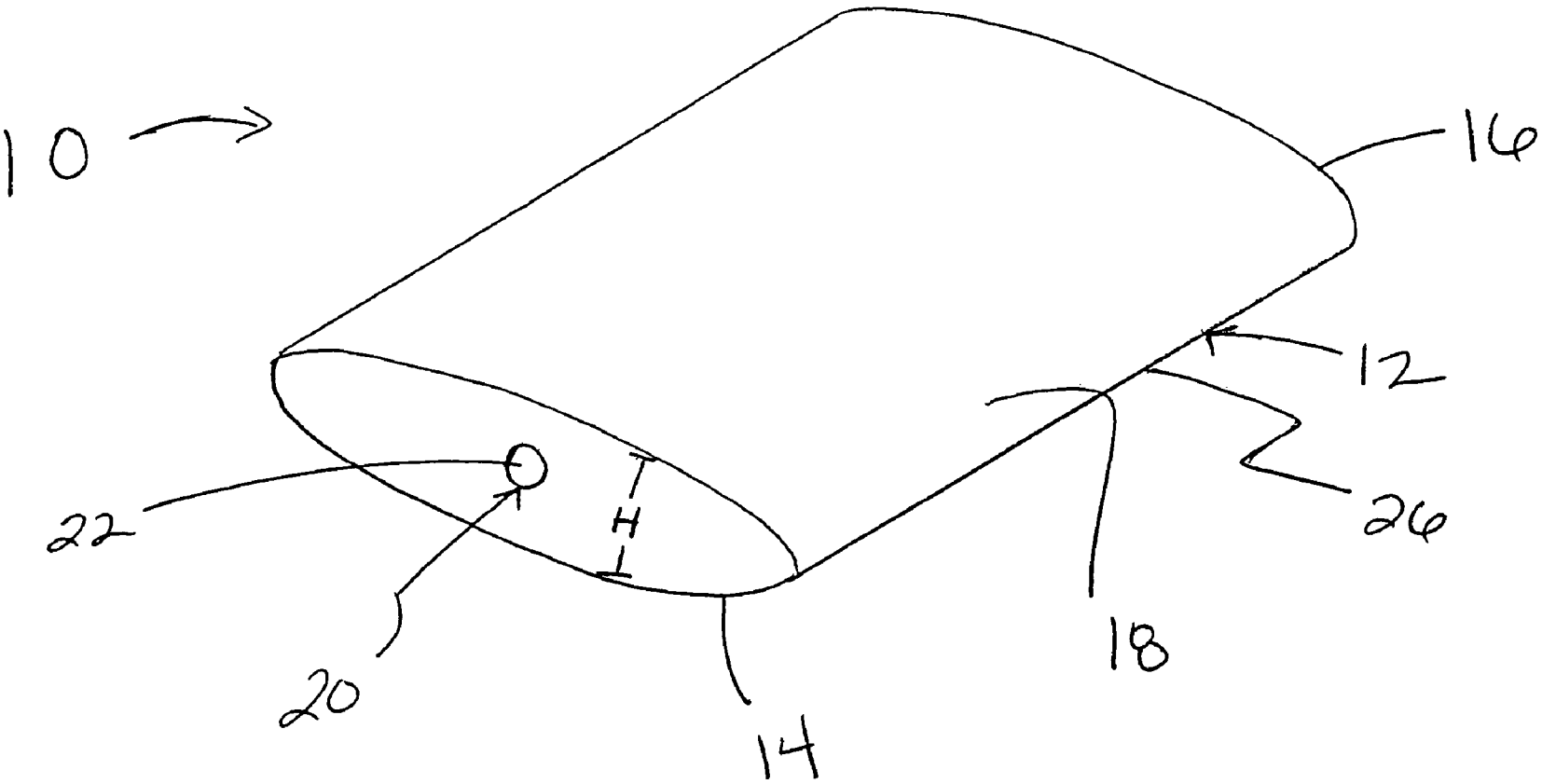
FIG. 1 is a perspective view of a positioning system pad in accordance with an embodiment of the invention.

Referring initially to FIG. 1, a positioning system 10 in accordance with the invention includes at least one pad, cushion or pillow 12 that is constructed from a foam core (not shown) and a cover 26. Exemplary cushion 12 includes two elliptical or circular shaped ends 14, 16 and an oblong shaped body portion 18. Positioning system pads may include operating room table pads, stretcher pads and positioning pads.

In one embodiment, valve 20 is located on or within elliptical end 14. Valve 20 is not limited to this location, however, and may be located on or within any suitable surface of cushion 12 including oblong body portion 18.

Valve 20 is generally a lid, plug, or cover 22 applied to an aperture (not shown) so that by its movement, as by swinging, lifting and falling, sliding, turning, etc., valve 20 will open or close the aperture to permit or prevent passage of a fluid (not shown) such as air. The form of valve 20 is not particularly important so long as it can be opened and sealed as desired to release air from a pad under compression or to allow air to return into a pad not under compression.

In some embodiments, valve 20 includes a check valve assembly (not shown) that prevents the flow of air when valve 20 is in its default position. By manipulating valve 20, such as by squeezing valve 20, the check valve is able to open to allow the passage of air.

In an alternate embodiment, valve 20 includes a removable check valve assembly (not shown). The check valve operates primarily as a conventional check valve and allows air to be introduced into cushion 12, but does not allow air out of cushion 12. When a user desires to release air from cushion 12, the check valve is simply removed by the user.

While valve 20 has been described thus far as including a check valve or check valve assembly, valve 20 may alternately include a clack valve, a screw valve, or a slide valve. Furthermore, in some embodiments, the air controlling device is internal to cushion 12 and thereby allows cushion 12 to self-inflate or self-deflate.

The foam core may be an open cell foam material selected from the group including, but not limited to, polyurethane, polyimide, and melamine. The foam core may take any shape, depending on the purpose of the shape of cushion 12 within positioning system 10. For example, referring still to FIG. 1, the foam core is the same general shape depicted by cushion 12.

Additionally, the foam core may be selected based on the compression modulus of the foam itself. In some embodiments, the compression modulus of the foam is less than 2.0. In still other embodiments, the compression modulus is less than 1.6. Compression modulus is generally defined as the ratio of a foam's ability to support force at different indentation or compression levels. Compression modulus is determined by taking the ratio of a foam's indentation force deflection (IFD) at 25% IFD and 65% IFD.

In one aspect of the invention, cover 26 is a moisture impermeable medical grade material selected from the group including, but not limited to: penn nylla, polyvinylchloride (PVC), polyurethanes, polyolefins, nylon, polyethylene terephthalate (PET), ethylene vinyl acetate (EVA), and acrylonitrile butadiene styrene (ABS).

In some embodiments, cover 26 may be formed from a conformable stretchable fabric that reduces high interface pressure. For example, it is preferable for the interface pressure on the skin of a patient to be at or below around 32 mm Hg. Interface pressure is herein defined as the highest pressure at which a capillary can remain open and sustain blood flow. In one aspect of the invention, Lycra-like fabrics may be used.

Cover 26 (and consequently cushion 12) are fluid impermeable water-proof and durable enough to withstand hospital cleaning disinfecting solutions.

In one embodiment, cover 26 is formed by radio frequency ("RF") welding its seams together. Radio frequency welding is the process of fusing materials together by applying radio frequency energy to the area to be joined, i.e. a seam. The resulting seam is impervious to fluids because, unlike stitched seams, no needle holes are created from the weld. Consequently, a benefit of RF welding is that the resulting weld can be as strong as the original materials. In addition, ultrasonic welding or heat sealing may be utilized.

The relationship between the foam core and cover 26 may vary, depending on the intended use of cushion 12 of positioning system 10. For example, in some embodiments, cover 26 fits snugly over the foam core. In such embodiments, cover 26 may or may not be connected to the foam core. Also, in the embodiment of FIG. 1, the height H, width and length (not shown) of cushion 12 are approximately the same dimensions as that of the foam core.

In alternate embodiments, cover 26 fits loosely over the foam core. While cover 26 may be connected to the foam core in such embodiments, more likely than not cover 26 will not be connected to the foam core. Because the amount of air within cushion 12 is adjustable, its height H, width and length (not shown) are variable, depending on the amount of air in cushion 12 and the height of the foam core. Additionally, the shape of cushion 12 depends on how pressure from a user is placed on cushion 12. For example, when cushion 12 is uncompressed, it will resemble the shape of the inflated cover 26. Alternately, when cushion 12 is barely inflated, it will resemble the shape of the foam core. Therefore, cushion 12 is easily shaped to the desired configuration to provide desired support and firmness, while retaining sufficient resiliency to maintain the desired firmness until it is changed by the user.

A problem with prior positioning systems is that in many instances, the amount of air in a cushion when compressed by the patient's body weight at ambient pressure is too great, making the pad too firm. A benefit of positioning system 10 is that the user may release air from of cushion 12 via valve 20, thereby decreasing the volume and firmness of cushion 12. This release of air reduces interface pressure and may decrease the likelihood of patients developing pressure points and bed sores. Furthermore, this release of air assists in maintaining an interface pressure of less than about 32 mm Hg.

Figure 2:
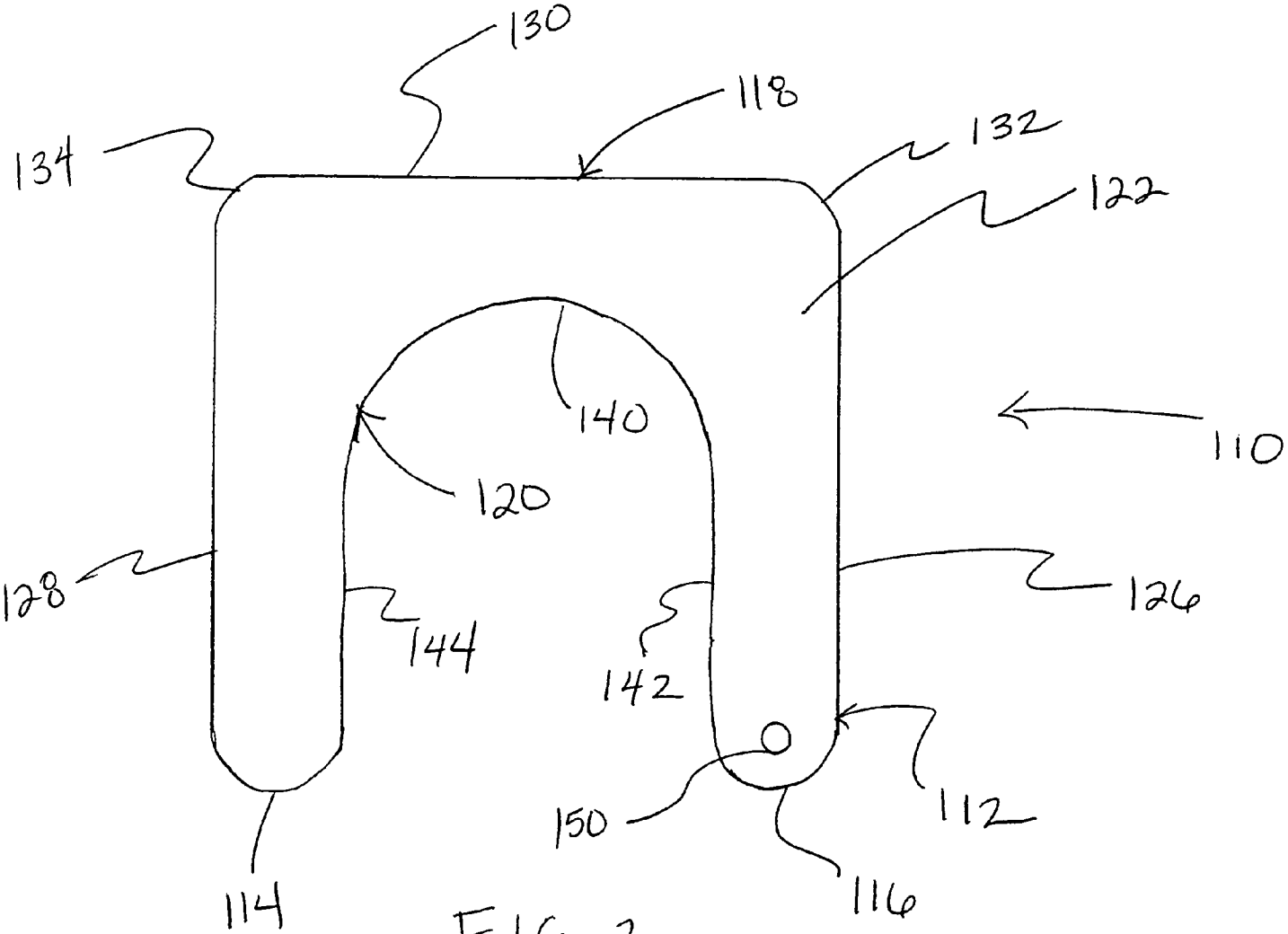
FIG. 2 is a perspective view of a positioning system pad in accordance with an embodiment of the invention.

Referring now to FIG. 2, positioning system 110 in accordance with another embodiment includes a cushion 112 and a foam core (not shown). Cushion 112 includes two semi-circular shaped ends 114, 116, and a U-shaped body 122. It should be noted that U-shaped body 122 and semi-circular ends 114, 116 generally constitute one continuous structure, i.e. cushion 112. For example, an embodiment depicted in FIG. 2 may be four inches high and include RF welded seams U-shaped body 122 includes an outer surface 118 and an inner surface 120. Outer surface 118 includes two elongated side portions 126, 128 and a back portion 130. Elongated side portions preferably extend from back portion 130 to semi-circular ends 116, 114. In one embodiment, two curved corner portions 132, 134 provide a transition between side portions 126, 128 and back portion 130.

Similarly, inner surface 120 includes a U-shaped back portion 140 and two side portions 142, 144. Side portions 142, 144 preferably extend from back portion 140 to semi-circular ends 116, 114.

In one embodiment, valve 150 is located on or within semi-circular end 116 or 114. In alternate embodiments, valve 150 may be located on or within outer surface 118, inner surface 120, or other suitable surfaces of U-shaped body 122. Similar to valve 20, valve 150 provides a means for permitting or preventing passage of air into or out of cushion 112.

Figure 3:
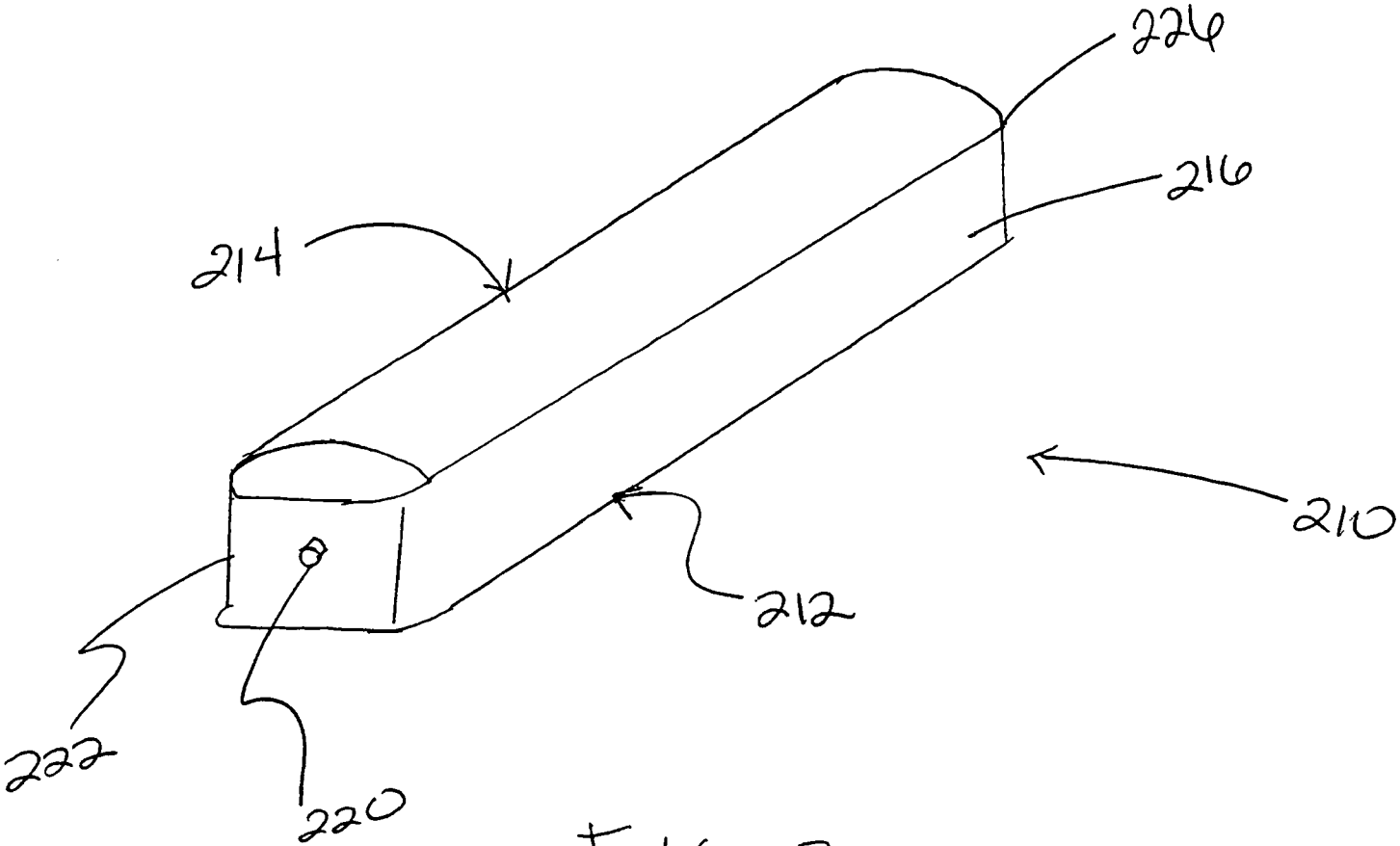
FIG. 3 is a perspective view of a positioning system pad in accordance with an embodiment of the invention.

Referring now to FIG. 3, a positioning system 210 in accordance with a further embodiment is shown including cushion 212 having a foam core (not shown). Cushion 212 includes a semi-cylindrical shaped first body portion 214 and a generally square or rectangular shaped hexahedral second body portion 216. Rectangular shaped body portion 216 preferably includes five sides with semi-cylindrical shaped body portion 214 functioning as its sixth side.

In one embodiment, a valve 220 is located on or within a front side 222 of rectangular body portion 216. In alternate embodiments, valve 220 may be located on or within other surfaces of rectangular body portion 216 or on or within surfaces of semi-cylindrical body portion 214.

While positioning system 210 is shown with first body portion 214 and second body portion 216 as part of one continuous body 226 where one valve 220 is necessary to inflate/deflate continuous body 226, it is contemplated that first body portion 214 and second body portion 216 make up separate, non-continuous bodies (not shown). In such embodiments, at least two valves 220 may be necessary to control air release in the separate bodies, providing additional positioning or cushioning options. For example, the embodiment depicted in FIG. 3 may include an adult chest roll twenty inches long, five inches high and six inches wide with a rounded top portion having RF welded seams.

Figure 4:
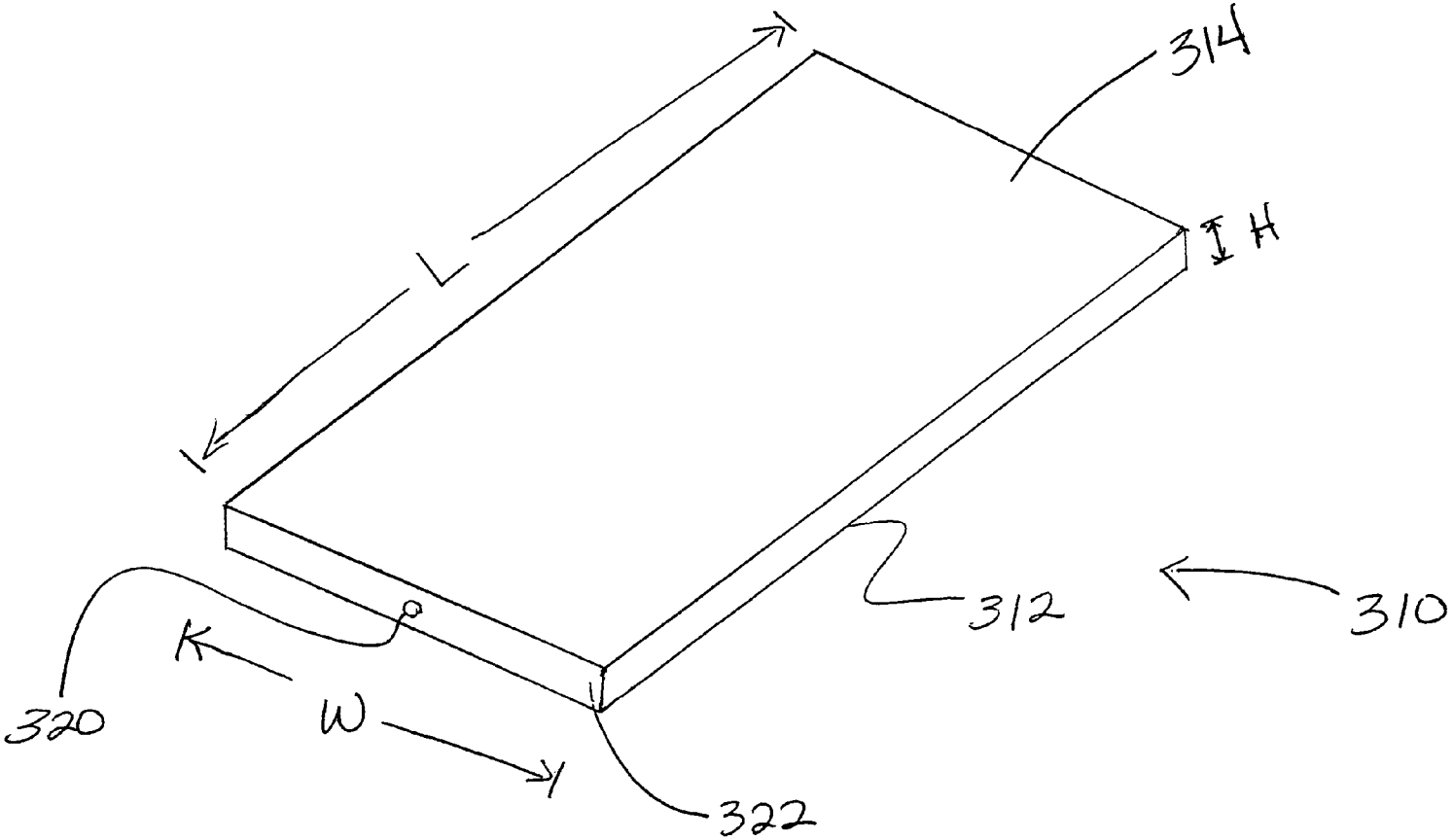
FIG. 4 is a perspective view of a positioning system pad in accordance with an embodiment of the invention.

Referring now to FIG. 4, a positioning system 310 in accordance with an additional embodiment is shown including a cushion 312 having a foam core (not shown). Cushion 312 is preferably a generally square or rectangular shaped hexahedron 314. In some embodiments, the length L and width W of hexahedron 314 are at least twice as great as height H. In other embodiments, the values of length L, width W, and height H vary considerably. Various embodiments may include hook and loop straps.

Similar to other embodiments, cushion 312 includes a valve 320. As shown in FIG. 4, valve 320 is located on or within front side 322 of hexahedron 314. In alternate embodiments, valve 320 may be located on or within other surfaces of hexahedron 314.

Figure 5:
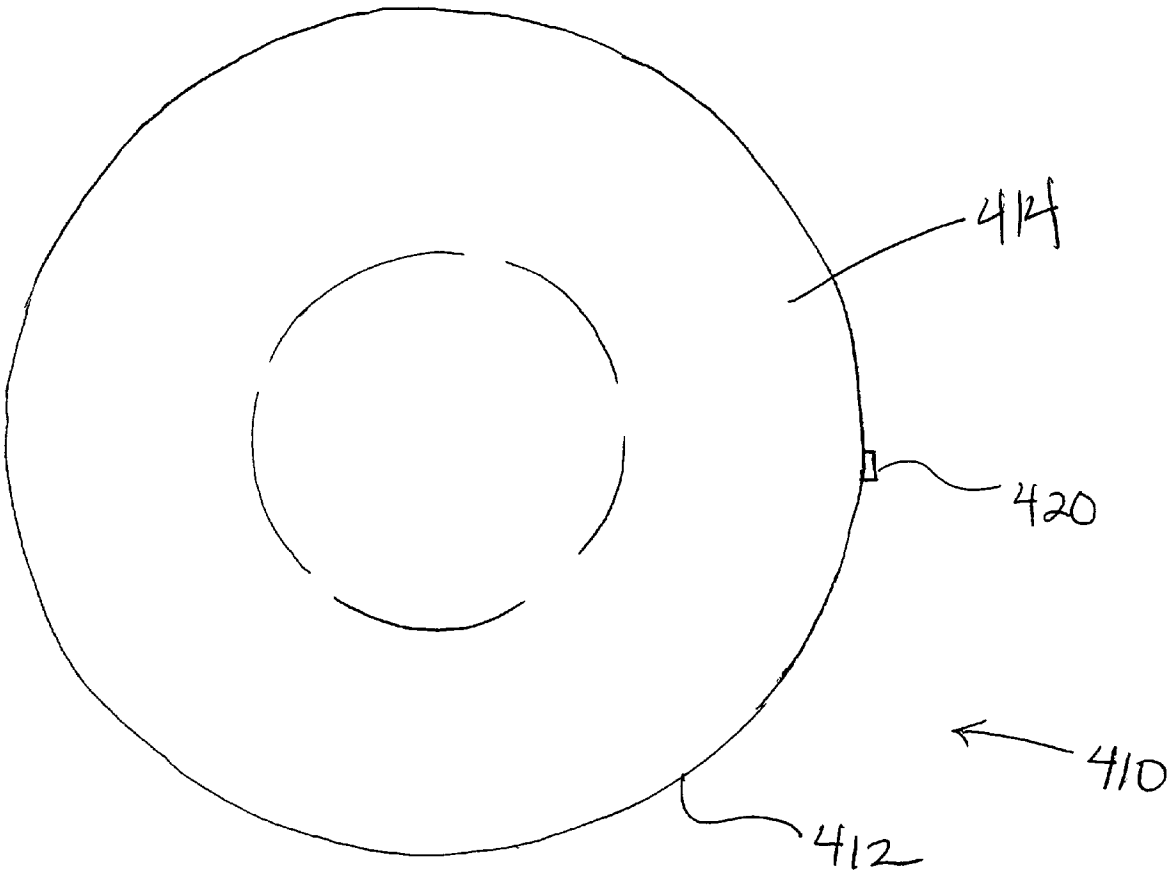
FIG. 5 is a perspective view of a positioning system pad in accordance with an embodiment of the invention.

Referring now to FIG. 5, a positioning system 410 in accordance with another embodiment is shown including a cushion 412 and a foam core (not shown). Cushion 412 is preferably shaped like a ring or donut 414 and includes valve 420. Similar to previous embodiments, valve 420 may be located on or within any surface of donut 414 and valve 420 provides a means for permitting or preventing passage of air into or out of cushion 412.

Other suitable design shapes for aspects of positioning system 10 include, but are not limited to, cushions shaped like a wedge, a rectangle or rectangular hexahedron having grooves extending across the surface, a circular ring, a roll (similar to positioning system 110), and a square or square hexahedron having an empty circular core. For further examples of cushion shapes, see Appendix B, incorporated herein by reference.

Optional features that may be present on any portion of positioning system 10, 110, 210, 310, and 420 include flanged edges or seams on the covers. Additionally, the covers may include one or more patterned or non-skid surfaces, so that the positioning systems stay in place. However, surface that make contact with a patient's skin are desirably formed of stretchable, conformable polyurethane fabric. Further desirable features may also include mechanical fasteners such as hook and loop straps or the like located on the covers so that a user can attach the positioning systems to his hospital bed or person for proper positioning.

In use, a medical professional selects one or more appropriate pads from positioning system 10 and places the pads in a desired position under or proximate to a patient's body. The user places weight on the positioning system by virtue of his or her body or body portion. The medical professional then adjusts the positioning system accordingly; if the positioning system is too firm, the nurse releases air from the pad. The nurse may optionally change the pad out with a more appropriate positioning system or add more pads as needed or desired.

In another aspect of the invention, a surgical table pad 422 and stretcher pad 423 are a part of surgical positioning system 10. Referring to FIGS. 6-11, the surgical table pad 422 includes a variety of configurations usually including three to five parts. Generally, surgical table pad 422 includes head pad 424, torso pad 426, foot pad 428 and two arm board pads 430.

The surgical table pad of the present invention is at least four inches thick, which is substantially thicker than the more commonly available two inch thickness surgical table pads. The surgical table pad 422 further includes a fluid impermeable cover that has seams 432 which are sealed by Radio Frequency welding, electronic or heat welding. Surgical table pad 422 further includes a series of Velcro attachments (not shown) to stop slippage on the operating room table. The attachments, in one aspect of the invention, are located at the bottom of the base of surgical table pad 422. The surgical table pad 422 is covered with a stretchable, conformable fabric which has improved tactile qualities for contact with the patient's skin. The surgical table pad 422 further includes a foam inner core.

A three piece surgical table pad 422 system in accordance with the present invention includes at least a head pad 424, a torso pad 426, and a foot pad 428.

An example head section 424 is approximately ten inches in length, twenty inches in width and four inches in height for a conventional surgical table. Other surgical tables may vary in size, in particular a bariatric surgical table for exceptionally large patients may substantially larger than these dimensions.

Figure 6:
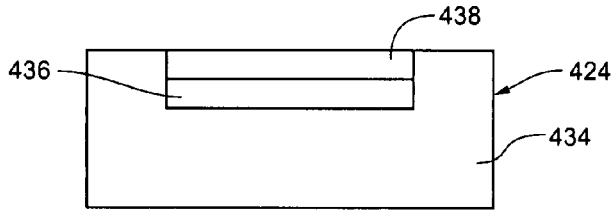
FIG. 6 is a cross-sectional depiction of a head section in accordance with the present invention.

The head pad 424 includes an outer foam portion 434, a soft foam portion 436 and a memory foam portion 438. As depicted in FIG. 6 the outer foam portion 434 includes the outer perimeter of the head pad 424, as well as the base of the head section 424. The memory foam portion 438 and soft foam portion 436 are formed as an insert into the outer foam portion.

An example torso pad 426 will typically be forty to forty-six inches in length, twenty inches in width, and four inches in height. Again, these dimensions may vary depending upon the application. The torso pad 426 also includes a dense outer foam portion 440, a soft foam portion 442, and a memory foam portion 444. In one embodiment, memory foam portion 444 and soft foam portions 442 are overlaid with the soft foam portion 442 beneath the memory foam portion 444 and inset into the dense foam portion 440 of the torso pad 426. In one example embodiment, the memory foam portion 444 is approximately one-half inch thick and the soft foam portion 442 is approximately one-half inch thick.

Figure 7:
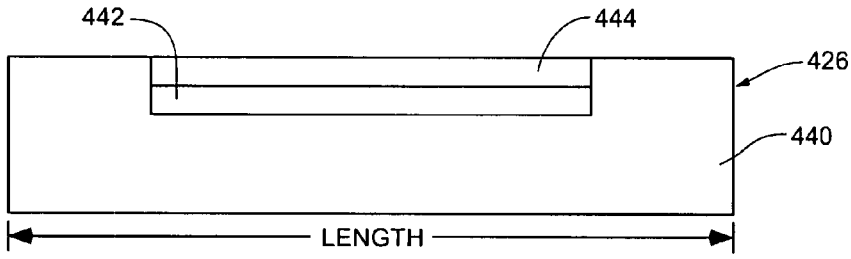
FIG. 7 is a sectional view of a torso section in accordance with the present invention.
Figure 8:
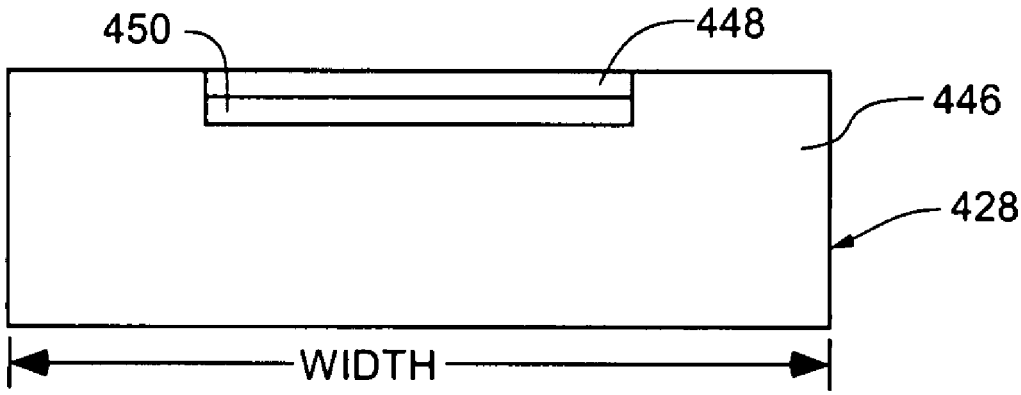
FIG. 8 is a sectional view of an example foot section in accordance with the present invention.
Figure 9:
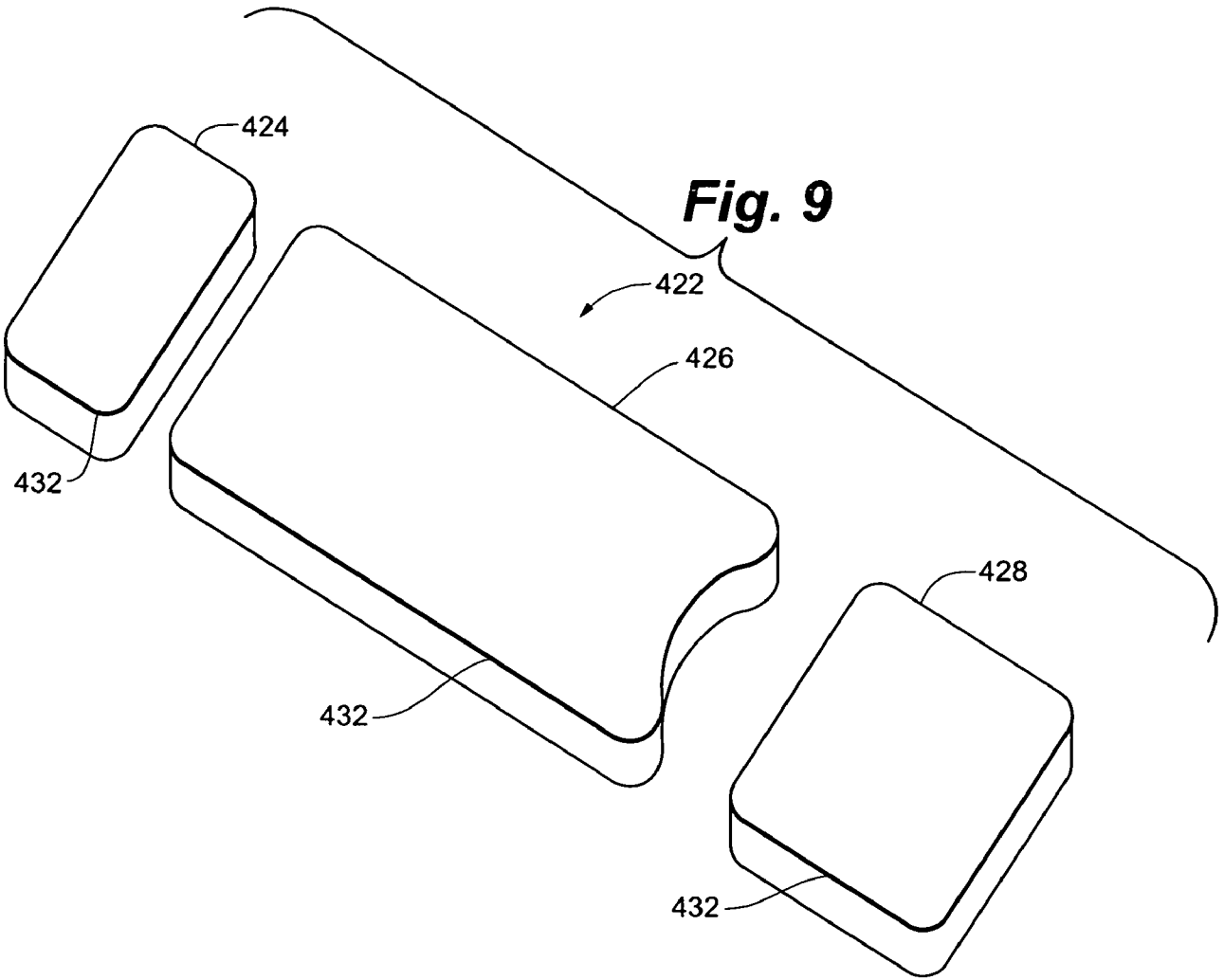
FIG. 9 is perspective view of a set of surgical table pads in accordance with the present invention.
Figure 10:
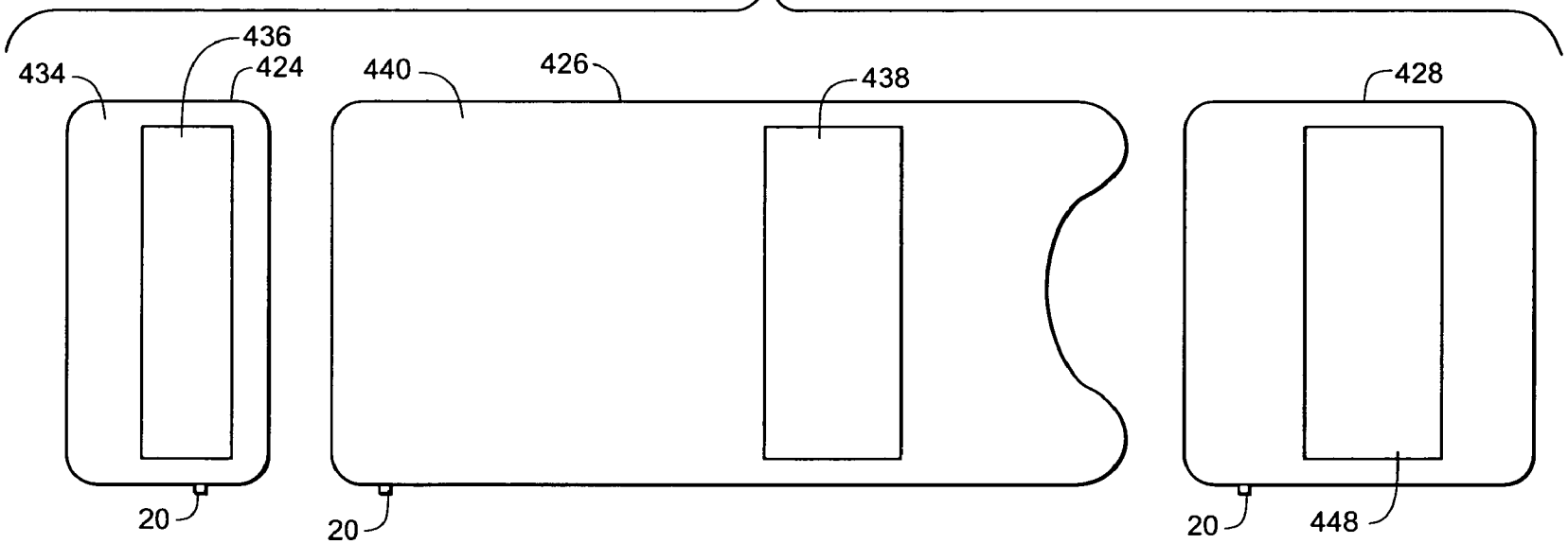
FIG. 10 is a plan view of the set of surgical table pads of claim 9.
Figure 11:
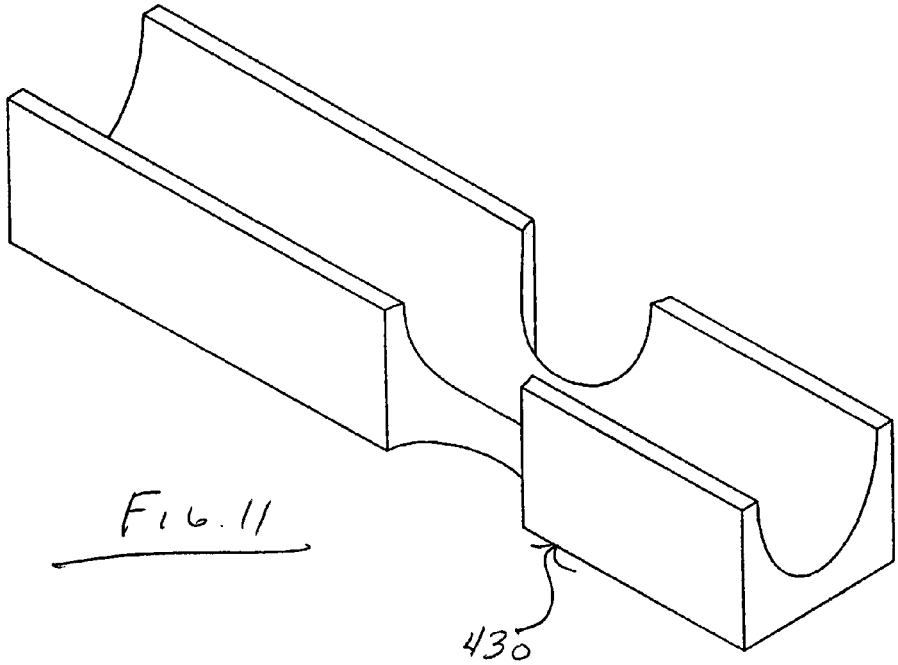
FIG. 11 is a perspective view on an arm board pad in accordance with the present invention.

Referring to FIG. 7 in one embodiment of the torso pad 422, the memory foam portion 444, soft foam portion 442 inset occupies approximately the central fifty percent of the torso section pad by length. This dimension may vary from thirty five to sixty five percent. This allows for lower interface pressure on the lower back and sacral portion of the body, which are a common location for the development of the decubitus ulcers.

The torso pad 426 may also include pressure release valve 20 to allow for lowering of interface pressure by release of air from within the torso pad 422.

The foot pad 428 for most surgical tables, in one aspect of the invention, is approximately twenty by twenty four inches or twenty by forty-four inches and four inches thick. In one example embodiment of the invention, the foot pad 428 has a dense foam base 446 and an inset formed of memory foam portion 448 laid over soft foam portion 450. In one example embodiment, the inset portion is approximately six inches wide, centrally located between two seven inch portions along the twenty inch width of the foot pad 428. Similar to a previously disclosed embodiment, in one aspect of the invention, the foot pad 428 includes a one-half inch layer of memory foam overlaid over a one-half inch layer of soft foam inset into the dense foam base 446.

In another aspect of the invention, a series of surgical positioning pads include welded fluid proof seams, soft conformable fabric covers and a variety of foam densities distributed throughout the pad. Depending upon the area of use intended, some surgical pads include valves 20 that can open and close and release air to allow more conformability of the positioning pads to the patient. In particular, pads that are used under boney prominences and areas of increased interface pressure with the patient's body during surgical procedures benefit from having release valves 20 to release pressure within the pads.

This ability to adjust interface pressure of the pad on key pressure points of the patient's body allows the distribution of the weight of the patient over the surface of the pad and further allows the patient to better tolerate long or short surgical procedures while reducing the occurrence of postoperative injury such as the decubitus ulcers, tissue damage and nerve damage.

When considering the torso pad 426 of the present invention, the insert foam portion can extend from about thirty-five percent to sixty-five percent of the length of the torso pad 426. The inset section generally will be located in the central portion of the pad symmetrically to provide for ease of use so that the pad will not be misplaced if it is put on the surgical table with the head end switched with the foot end. In addition, the inset portion will generally occupy approximately the central thirty percent of the width of the surgical table pad. For example, in the foot section, the foam inset including memory foam and soft foam may extend from twenty to forty percent of the width of the foot section pad.

Generally, the inset portion will occupy the top twenty-five percent of the thickness of the surgical table pads. In one aspect of the invention, the memory foam portion will occupy ten to fifteen percent of the thickness of the pad and the soft foam portion will occupy from ten to fifteen percent of the thickness of the pad. In one embodiment of the invention, the thickness of the memory foam portion and the soft foam portion are approximately equal, though this should not be considered limiting as other combinations may be used.

The present invention may also include a stretcher pad having dimensions of approximately seventy-six inches by twenty-nine inches. The stretcher pad may also have a center inset portion, a foot inset portion and a pressure release valve as discussed above with relation to the surgical table pads.

The invention may be embodied in other forms without departing from the spirit of essential attributes thereof; therefore the illustrated embodiments should be considered in all respects as illustrative and not restrictive. For example, while portions of the positioning systems 10, 110, 210, 310 and 410 shown in FIGS. 1-5 generally constitute a single continuous cushion having one valve, its is contemplated that the positioning systems may constitute a plurality of non-continuous portions having a plurality of valves.

Additionally, while various example embodiments of positioning systems are shown in FIGS. 1-5, it is contemplated that any combination of portions of positioning systems 10, 110, 210, 310, and 420 may be used simultaneously to construct additional positioning system arrangements. Furthermore, it should be appreciated that positioning systems 10, 110, 210, 310, and 420 are example embodiments, and that the positioning systems in accordance with the present invention may take any suitable shape, and not be limited to the shapes shown in the Figures.

What is claimed is:

1. A positioning system for use in a perioperative environment, comprising:

at least one positioning cushion;

a table or stretcher pad having a top surface area, a length, a width and a depth;

the table or stretcher pad including a resilient foam pad of a dense foam covered by a substantially fluid impermeable conformable fabric cover having substantially fluid impermeable welded seams;

the resilient foam pad having an first inset portion that covers less than fifty percent of the top surface area, the inset portion being formed of a softer foam than the dense foam; and a head pad and a foot pad, the head pad comprising a second inset portion and the foot pad comprising a third inset portion.

2. The positioning system as claimed in claim 1, wherein the first inset portion comprises a combination of memory foam and soft foam.

3. The positioning system as claimed in claim 1, wherein the first inset portion extends downwardly from the top surface from about fifteen and fifty percent of the depth of the table or stretcher pad.

4. The positioning system as claimed in claim 3, wherein the first inset portion extends downwardly from the top surface about twenty five percent of the depth of the table or stretcher pad.

5. The positioning system as claimed in claim 1, wherein the first inset portion extends about thirty five percent to about sixty five percent of the length of the table or stretcher pad.

6. The positioning system as claimed in claim 1, wherein the first inset portion extends about fifty percent of the length of the table or stretcher pad.

7. The positioning system as claimed in claim 1, wherein the first inset portion is positioned to support bony prominences of a patient's torso, the second inset portion is positioned to support bony prominences of the patient's head and the third inset portion is positioned to support bony prominences of the patient's feet wherein the first inset portion comprises a combination of memory foam and soft foam;

further wherein the first inset portion extends downwardly from the top surface about twenty five percent of the depth of the pad; and wherein at least one of the positioning cushion or the table or stretcher pad further comprises a valve operably coupled to the substantially fluid impermeable conformable fabric cover whereby gas within the substantially fluid impermeable conformable fabric cover can be selectively released.

8. The positioning system as claimed in claim 1, wherein at least one of the positioning cushion or the table or stretcher pad further comprises a valve operably coupled to the substantially fluid impermeable conformable fabric cover whereby gas within the substantially fluid impermeable conformable fabric cover can be selectively released.

9. The positioning system as claimed in claim 1, wherein the first inset portion is positioned to support bony prominences of a torso of a patient supported on the table or stretcher pad whereby the risk of pressure induced tissue injury is reduced.

10. The positioning system as claimed in claim 1, wherein the first inset portion is positioned to support bony prominences of a patient's torso, the second inset portion is positioned to support bony prominences of the patient's head and the third inset portion is positioned to support bony prominences of the patient's feet.

11. A kit for positioning patients in a perioperative environment, comprising:

at least one positioning cushion;

a pad to at least partially support a patient on a horizontal surface, the pad having a top surface area, a length, a width and a depth;

the pad including a resilient foam member of a dense foam enclosed by a substantially fluid impermeable conformable fabric cover; and the resilient foam member having an first inset portion located to support at least one bony prominence of the patient, the inset portion being formed of a softer foam than the dense foam; and a head pad and a foot pad, the head pad comprising a second inset portion and the foot pad comprising a third inset portion;

wherein the first inset portion is positioned to support bony prominences of a patient's torso, the second inset portion is positioned to support bony prominences of the patient's head and the third inset portion is positioned to support bony prominences of the patient's feet wherein the first inset portion comprises a combination of memory foam and soft foam;

further wherein the first inset portion extends downwardly from the top surface about twenty five percent of the depth of the pad; and wherein at least one of the positioning cushion or the pad further comprises a valve operably coupled to the substantially fluid impermeable conformable fabric cover whereby gas within the substantially fluid impermeable conformable fabric cover can be selectively released.

12. The kit as claimed in claim 11, wherein the first inset portion is positioned to support bony prominences of a torso of a patient supported on the pad whereby the risk of pressure induced tissue injury is reduced.

13. The kit as claimed in claim 11, wherein the first inset portion comprises a combination of memory foam and soft foam.

14. The kit as claimed in claim 11, wherein the first inset portion extends downwardly from the top surface from about fifteen and fifty percent of the depth of the pad.

15. The kit as claimed in claim 14, wherein the first inset portion extends downwardly from the top surface about twenty five percent of the depth of the pad.

16. The kit as claimed in claim 11, further comprising a head pad, the head pad comprising a second inset portion located to support bony prominences of the head.

17. The kit as claimed in claim 11, further comprising a foot pad, the foot pad comprising a third inset portion located to support bony prominences of the feet.

18. The kit as claimed in claim 11, wherein at least one of the positioning cushion or the pad further comprising a valve operably coupled to the substantially fluid impermeable conformable fabric cover whereby gas within the substantially fluid impermeable conformable fabric cover can be selectively released.

* * * * *